US005431333A

United States Patent [19]

Lorenz

[11] Patent Number: 5,431,333

[45] Date of Patent: Jul. 11, 1995

[54] CLOSABLE BOX

[75] Inventor: Achim R. Lorenz, Burns, Tenn.

[73] Assignee: MacMillan Bloedel Limited, Vancouver, Canada

[21] Appl. No.: 262,297

[22] Filed: Jun. 20, 1994

Related U.S. Application Data

[63] Continuation-in-part of Ser. No. 191,221, Feb. 3, 1994, abandoned.

[51] Int. Cl.[6] ..... B65D 5/22

[52] U.S. Cl. ..... 229/114; 229/146; 229/149; 229/906

[58] Field of Search ..... 229/114, 146, 149, 902, 229/906

[56] References Cited

U.S. PATENT DOCUMENTS

| | | | |
|---|---|---|---|
| 2,975,953 | 3/1961 | Muth | 229/149 |
| 4,232,816 | 11/1980 | Johnson et al. | 229/114 |
| 4,289,491 | 9/1981 | Collura et al. | 229/146 |
| 4,360,147 | 11/1982 | Brauner | 229/146 |
| 4,763,832 | 8/1988 | Forbes, Jr. | 229/149 |
| 4,877,178 | 10/1998 | Eisman | 229/114 |
| 4,951,865 | 8/1990 | Eisman | 229/149 |
| 4,955,527 | 9/1990 | Blackman et al. | 229/114 |
| 5,039,003 | 8/1991 | Gordon et al. | 229/114 |

FOREIGN PATENT DOCUMENTS

| | | | |
|---|---|---|---|
| 2509364 | 9/1975 | Germany | 229/149 |

*Primary Examiner*—Gary E. Elkins
*Attorney, Agent, or Firm*—C. A. Rowley

[57] ABSTRACT

A closable container is formed by a bottom tray having upwardly and outwardly flaring side wall and a cooperating gable-shaped top closure having side wall with a rear side wall of the top foldably interconnected with a rear side wall of the bottom tray along the length thereof. Flaps extending from the top front and rear walls connect these walls to their respective adjacent top side walls to form the gabled shaped top closure and are provided with extensions each of which projects away from the top wall of the top closure a distance farther than the free edge of the top side wall to which it is connected. These projections extend beyond the top edge of their adjacent bottom side walls and help to ensure proper alignment of the top closure and bottom tray. The front walls of the bottom tray and of the gabled top are formed respectively with an undercut and a cooperating tongue adapted to interact to hold the gabled top in close position over the bottom tray. Preferably, the bottom front wall in which the undercut is formed will extend further above the bottom wall of the tray than the other side walls of the tray and free edge of the front top wall of the gabled top will be received within the projecting portion and the undercut will be formed in the projecting portion to define a surface that the tongue lies against when the top is in close position.

10 Claims, 2 Drawing Sheets

CLOSABLE BOX

This application is a continuation-in-part of application Ser. No. 08/191,221 filed Feb. 3, 1994 now abandoned.

FIELD OF THE INVENTION

The present invention relates to box, more particularly the present invention relates to a closable box formed by a tray portion and a gabled top foldably interconnected.

BACKGROUND OF THE PRESENT INVENTION

Many different closable containers have been designed wherein a bottom tray with flaring side walls is closable by means of a gabled top foldably connected to the bottom tray along the top edge of one of the side walls. These containers are normally provided with some form of locking mechanism between the front walls of the gabled top and the bottom tray.

In any of the systems, the locking mechanisms generally are relatively unwieldable making closing of the box awkward and in many cases requiring more than one hand to manipulate interacting tongues and slots.

Many of these containers are molded from styrofoam or in some cases, are die-cut from chipboard or corrugated board or the like. One of the inherent problems containers is to use the minimum amount of material and yet provide a container wherein proper alignment of the top and bottom of the container when the container is in closed condition is better ensured.

BRIEF DESCRIPTION OF THE PRESENT INVENTION

It is an object of the present invention to provide a closable box formed by a bottom tray section and a top gabled section that are easily latched together to hold the box in closed position with the top and bottom properly aligned.

Broadly, the present invention relates to a closable container comprising a bottom tray having a bottom wall, a set of bottom side walls, a fold line connecting each bottom side wall of said set of bottom side walls to an adjacent portion of said bottom wall, said set of bottom side walls including a first pair of opposed bottom side walls connecting one to each of a pair of opposite sides of said bottom wall and forming a front bottom side wall and a rear bottom side wall of said tray, means for connecting adjacent sides said bottom side walls of said set of side walls to form said bottom tray with said bottom side walls extending upwardly from said bottom wall and flaring outward to provide an open top having its periphery defined by free-end edges of said bottom side walls, said open top being larger in area than said bottom wall, a gabled top having a top wall and a set of top side walls, means connecting each of said top side walls of said set of side walls with its adjacent edge of said top wall and means for interconnecting sides of adjacent pairs of said top side walls to form said gabled top with an open end remote from said top wall defined by the free edges of said top side walls remote from said top wall, said open end being larger in area than said top wall, said set of top side walls including a first pair of opposed top side walls forming a front top side wall and rear top side wall of said gabled top and a second pair of opposed top side walls, said means interconnecting sides of adjacent pairs of said top side walls including flaps foldably connected to the corners of each of said first pair of top side walls in a position to be secured to the adjacent corner of the adjacent side wall of said second pair of top side walls, projections extending from each of said flaps, each said extension extending beyond its adjacent of top side wall of said second pair of top side walls to overlap its adjacent corner of said bottom tray when said container is in closed position, a foldable connection between said rear bottom side wall and said rear top side wall to foldably connect said gabled top with said bottom tray.

Preferably said container will further comprise an extending portion extending from the end of said bottom front side wall remote from said bottom wall, said extending portion having a free edge spaced above said bottom wall a distance greater than the spacing of said foldable connection above said bottom wall and wherein said supporting surface is substantially parallel to said foldable connection and spaced essentially the same distance above said bottom wall as said foldable connection.

Preferably the distance between said foldable connection and a free edge of said front top wall remote from said foldable connection is substantially the same as the distance between said supporting surface and said foldable connection so that said free edge of said front top wall may be received within said extending portion of said bottom front wall.

Preferably said tongue will traverse said bottom front wall at an angle of at least 15°, more preferably at least 30°.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
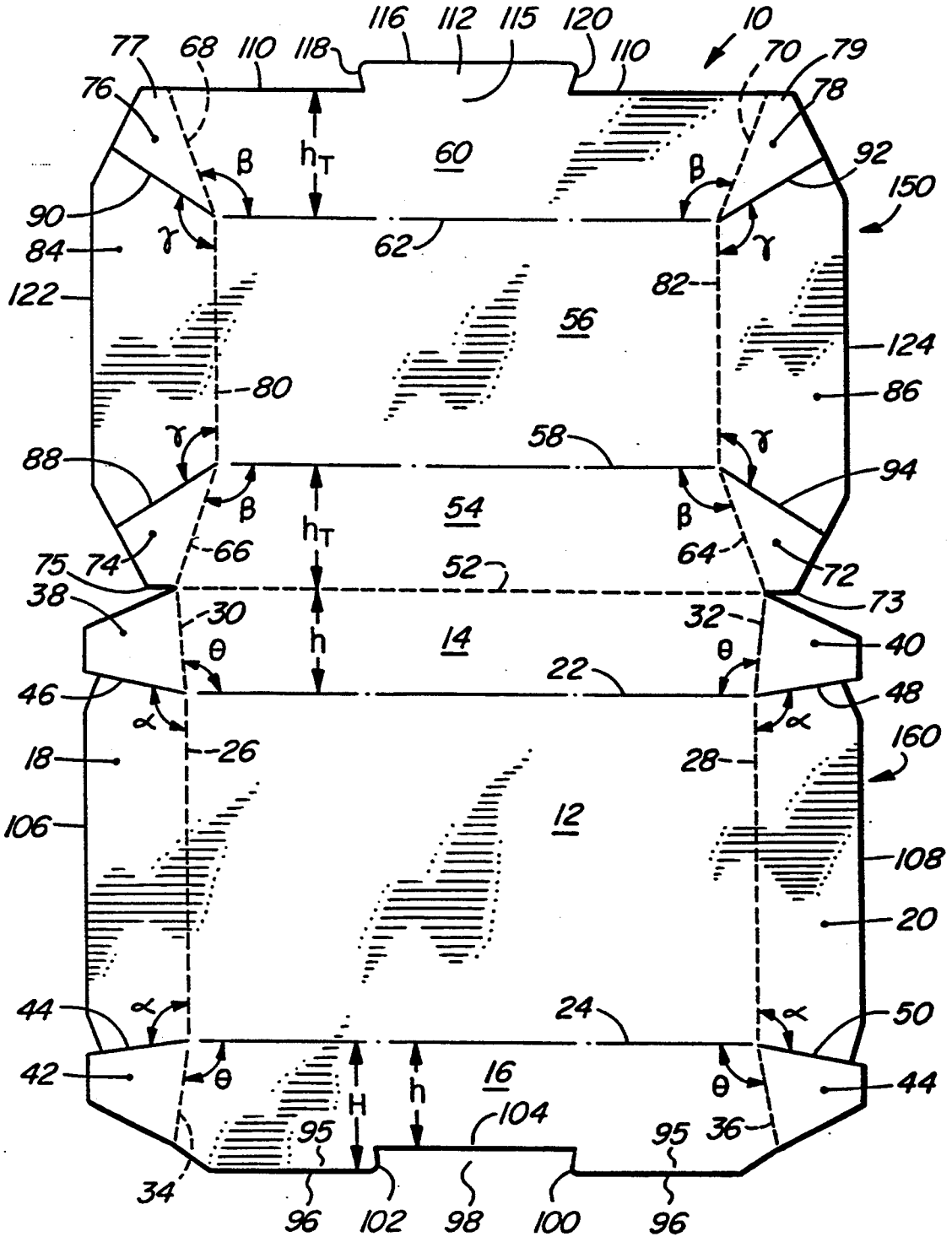
FIG. 1 is a plan view of a blank from which the present invention may be constructed.

As shown in FIG. 1, the blank 10 includes a bottom wall panel 12 having a first pair of opposed bottom side wall forming flaps 14 and 16 forming rear and front walls respectively of the bottom tray and a second pair of opposed bottom side wall forming flaps. 18 and 20 form end walls of the bottom tray. The flaps 14, 16, and 20 are connected to the bottom wall forming panel 12 via fold lines 22, 24, and 28 respectively. The fold lines 22 and 24 are substantially parallel and are perpendicular to the fold lines 26 and 28.

The sides of the side wall 14 are formed by fold lines 30 and 32 respectively which extend from the fold line 22 at included obtuse angles Θ so that the free end of the side walls 14 remote from the fold line 22 is symmetrical with and longer than the fold line 22. Similarly, the ends of the opposite side wall 16 of the first pair of opposed side walls is also formed by fold lines 34 and 36 and extend from the fold line 24 at included obtuse angle Θ substantially the same as the obtuse angles Θ between the fold lines 30 and 22 and 32 and 22. Connected to the side walls 14 and 16 by the fold lines 30, 32, 34, 36 respectively are bottom wall connecting flaps 38, 40 and 42 and 44 respectively.

The second pair of opposed bottom side walls 18 and 20 each have opposite ends thereof formed by tapered edges 44, 46, 48 and 50 respectively which extend from the adjacent ends of their respective adjacent fold lines 26 or 28 at obtuse angles as $\alpha$.

A fold line 52 interconnects the sides of rear wall 14 remote from the fold line 22 with a top rear side wall 54 of the gabled top. The wall 54 is connected to a top wall 56 via a fold line 58 substantially parallel to the fold lines 22, 24, 52. A top front wall 60 is connected to the opposite side of the top wall 56 from the top rear wall 54 by a fold line 62 substantially parallel to this fold line 58. The top rear and front side walls 54 and 60 respectively form a first pair of opposed top side walls. The sides of these top side walls 54 and 60 are defined by fold lines 64 and 66 and 68 and 70, all of which project from their respective adjacent fold lines 58 or 62 at an obtuse angle $\beta$. Connected to the sides of the top side walls 54 and 60 via the fold lines 64, 66, 68 and 70 are top connecting flaps 72, 74, 76 and 78 each of which is formed with a projecting portion indicated at 73, 75, 77 and 79 respectively.

Connected to the ends of the top wall 56 via fold lines 80 and 82 that are substantially perpendicular to the fold lines 58 and 62 is a second pair of opposed top side walls 84 and 86. The top side wall 84 has sides 88 and 90 extending outwardly from the fold line 80 at obtuse angle $\gamma$ and similarly the top side wall 86 has sides which is 92 and 94 extending one from each of the opposite end of the fold line 82 by the similar angle $\gamma$. The angle $\gamma$ obviously is also an obtuse angle.

It will be noted that the bottom front side wall 1.6 has a height H measured from the fold line 24 to the free edge 96 of the bottom front side wall 16 that is greater than the height $h_B$ between the fold lines 22 and 52. The wall 16 has an undercut 98 formed by the projections 100 and 102 on opposite sides of the undercut 98, the bottom of which is formed via a substantially straight line support surface 104 that is substantially parallel to the fold line 24 and is spaced from the fold line 24 by a distance substantially equal to the height $h_B$, i.e. the height of the wall 14 between the fold lines 22 and 52. The area of the wall 16 between the surface 104 and the free edge 96 define an extension 95 of the front wall 16 and its undercut 98 and projections 100 and 102 are found in the extension 97.

In the illustrated arrangement, the height $h_B$ are substantially the same since the angles $\alpha$ are substantially the same. If the angle $\alpha$ adjacent to the wall 14 were different from the angles a adjacent to the wall 16, then the height of the edge 104 from the fold line 24 might be different from height between the fold lines 22 and 52, and it is preferred to have the edge 104 and fold line 52 spaced from the bottom 12 in the erected container substantially the same distance as the edge forming the support surface 104 is from the bottom 12 which will also be substantially equal to the height of the free or top edges 106 and 108 of the other pair of bottom side walls 18 and 20 respectively, i.e. the bottom tray 160 will have a depth $D_B$ (see FIG. 3).

The top side wall 60 has the height $h_T$ between its free edge 110 and fold line 62 connecting it with the top panel 56 substantially equal to the height $h_T$ of the wall 54 measured between the fold lines 52 and 58.

As with the height $h_B$ of the walls 14 and 16, the height $h_T$ of the wall 60 and 54 may be different depending on whether or not the angle $\gamma$ adjacent thereto and forming the slope of the gabled top 150 (see FIG. 3) are the same, it being preferred to maintain the height or spacing of the free edge 110 of top front wall 60 from the top 56 substantially equal to the spacing of the fold line 52 from the top wall 56 (i.e. height of top rear wall 54).

The top front wall 60 has a substantially dove-tail projection or tongue 112 extending outwardly therefrom the further from the fold line 62 than the free edge 110. The projection 112 is substantially plainer with the rear under of the wall 60 and terminates in a free edge 116 substantially parallel to the fold line 62. The projection 102 has undercut sides 118 and 120 so that the free edge 116 of the tongue 112 is longer than the base 115 of the tongue 112 where it connects directly to the panel 60.

The tongue 112 is positioned and sized to be received within the undercut 98 formed in the bottom wall 16, i.e. the length of the projection or tongue 112 at its base 115 measured parallel to the fold line 62 is adapted to extend substantially the full length of the support surface 104 of the undercut 98.

Each of the top side walls 84 and 86 is provided with a free edge 122 and 124 respectively which are substantially parallel to their respective fold lines 80 and 82. In the illustrated arrangement, the free edges 122 and 124 in the erected box will be spaced from the top panel 56 by essentially the same distance as are the edges 110 and the fold line 52 so that the depth $D_T$ (see FIG. 3) of the gabled top 150 will be substantially uniform around the periphery of the top.

To produce the box of the present invention, adhesive is applied to the flaps 38, 40, 42 and 44 and these flaps are folded on their respective fold lines 30, 32, 34 and 36 to a position substantially perpendicular to the walls 14 and 16 and the walls 14 and 16 are folded along the fold lines 22 and 24 to extend at an angle $\alpha$ to the bottom panel 12, next the panels 18 and 20 are folded into contact with the adjacent flaps 38 and 42 and 40 and 44 respectively and are secured to form a bottom tray composed of the first pair of opposed side walls 14 and 16 (bottom rear and front walls) and a second pair of opposed side walls 18 and 20 all extending upward and outwardly from the bottom wall 12 to form a tapered tray 160 (see FIG. 3) having a bottom 12 smaller than its open top as defined by the free edges 96, 106, 108 and the fold line 52.

The gabled top 150 (see FIG. 3) is formed in a similar manner by applying adhesive to the flaps 72, 74, 76 and 78 and folding them on fold lines 64, 66, 68 and 70 to position substantially perpendicular to top walls 54 and 60 and then folding the walls 54 and 60 relative to the top wall 56 on fold lines 58 and 60 followed by folding of the side top walls 84 and 86 into contact with the flaps 74 and 76 and 72 and 78 respectively and securing them to the flaps 72, 74, 76 and 78 to form a gabled top.

It will be apparent that the tapered bottom tray will be formed with the walls 18 and 20 extending at an angle Θ from the bottom wall 12 while the rear wall 14 and front wall 16 extend at an angle $\alpha$ therefrom. Similarly, the top side walls 84 and 86 will extend at an angle $\beta$ to the top wall 56 while the top rear wall 54 and top front wall 60 will extend at an angle $\gamma$ to the top wall 56.

It is preferred that the angle $\gamma$ be significantly larger than angle $\alpha$ and similarly that the angle $\beta$ be larger than the angle $\Theta$. Since the walls 12 and 56 in the closed container will normally be substantially parallel, the angle $\beta$ between walls 56 and 60 and $\Theta$ between walls 12 and 16 define the angle w (see FIG. 3) which will be described below.

The tapered bottom tray and tapered gabled top 150 when open, i.e. arranged with thin bottom and top walls 12 and 56 respectively in the same plane permits nested stacking of a plurality of these containers with the bottom tray 160 of one container nested in the bottom tray 160 of the next lower container in the stack and with the gabled top 150 of one container nested in the gabled top 150 of the next lower container in the stack.

Figure 3:
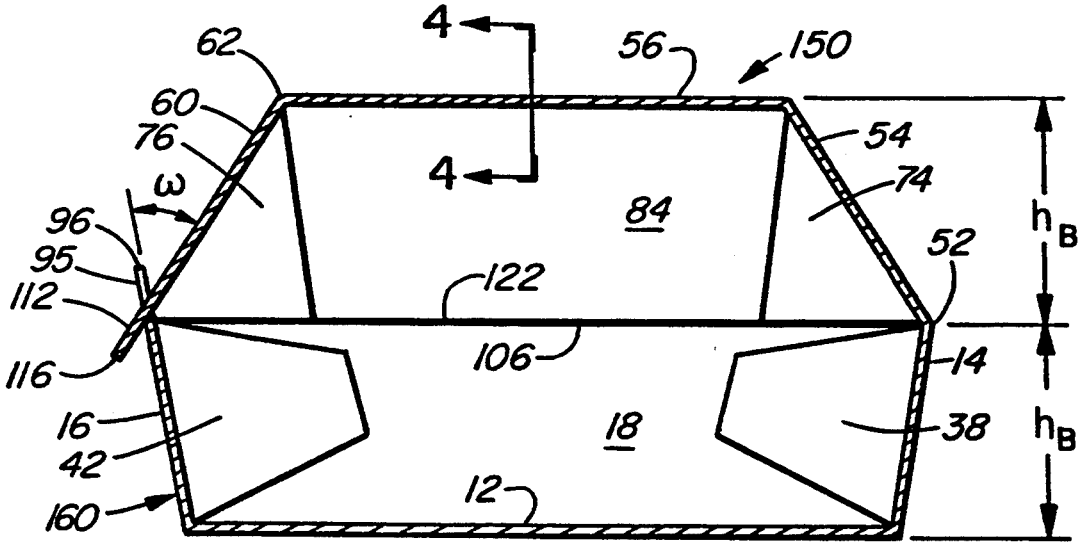
FIG. 3 is a transverse section across the container of FIG. 2 in close position showing the interlock and the interaction between the tongue and undercut section.

By folding on the fold line 52, the bottom panel 12 and top panel 56 may be positioned substantially parallel to one another and preferably, the depth $D_B$ of the bottom tray, i.e. the spacing from the bottom panel to the fold line 52 will be essentially the same as depth $D_T$ of the gable to p, i.e. the spacing between the top panel 56 and the fold line 52 so that when the fold line 52 is folded to completely open the box, the top and bottom panels 12 and 56 respectively may lay flat upon a flat supporting surface (when the carton is in wide open position, the bottom wall 12 and top wall 56 may be positioned in substantially the same plane, i.e. $D_T$ is equal to $D_B$ (see FIG. 3).

Figure 2:
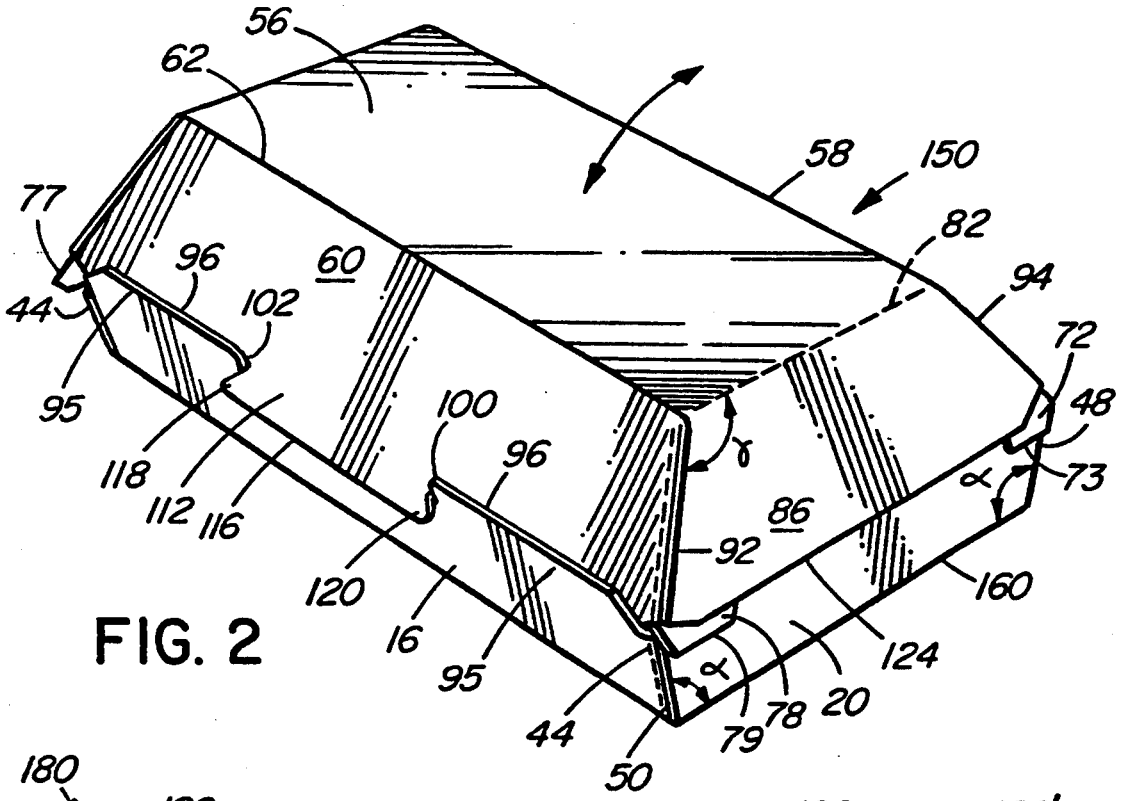
FIG. 2 is an isometric view illustrating a closable container constructed in accordance with the present invention and showing the container in closed position.

The erected container in closed position is shown in FIGS. 2 and 3 which as can be seen, produces a substantially fully closed box with the free edge 110 of the front top wall 60 received within the extension or projection 95 of the bottom wall 16 and with the tongue 112 received within the undercut 98, i.e. the tongue is in essentially face to face contact with the edge 104 of the undercut 98 to hold the box in close position. As can be seen, the edges 122 and 124 of the top walls 84 and 86 lie on the edges 106 and 108 of the bottom walls 18 and 20 to help to support the gabled top 150 on the tapered bottom tray 160.

The walls 16 and 60 should cross at an angle w greater than 15° preferably greater than 30° for the latching and supporting action between the projection 172 and surface 104 and the action of abutment of the free edge 110 of wall 60 with the inside of wall 16 adjacent or on extension 95 to support the top 150.

As will be apparent from FIG. 2, the projections 73, 75, 77 and 79 (only the latter three shown in FIG. 2) extend beyond the free edge 122 and 124 of the side walls 84 and 86 and project down outside of the bottom side walls 18 and 20. These projections 73, 75, 77 and 79 which are the only portion of the top that extends below the free edges of the side bottom walls 18 and 20 to better ensure that the top 150 remains in alignment with the bottom 160, i.e. the top 150 does not shift laterally with respect to the bottom 160 since the flap projections 73 and 79 are positioned adjacent to the outside of bottom side wall 20 and the projections 75 and 77 are similarly positioned on the outside of the bottom side wall 18. As shown, each projection 73, 75, 77 and 79 is positioned at its respective adjacent corner of the bottom tray.

This simple extensions of the flaps which require no additional board (are formed from what otherwise would be waste) add a significant advantage and improvement to the box structure by better ensuring that the top 150 and bottom 160 remain substantially in the desired alignment when the box is closed, thereby better ensuring the insulating value of the box relative to material contained therein. These flap extensions 73, 75, 77 and 79 in effect result in an interesting of the top 150 and bottom 160 on two sides to maintain alignment in one direction. Alignment in the direction perpendicular to the one direction is attained by the hinge 52 and the tongue 112 fitting within the undercut 98 on the remaining side to thereby provide a more stable closed container. The interaction of the tongue 112 and undercut 98 resists lateral movement in two mutually perpendicular directions as does the hinge 52.

Figure 4:
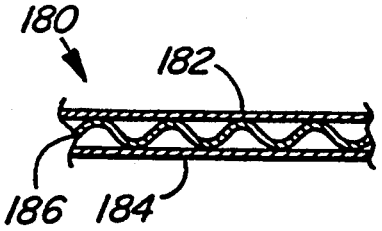
FIG. 4 is a section along the line 4—4 of FIG. 3, illustrating one form of material from which the present invention may be constructed.
Figure 5:
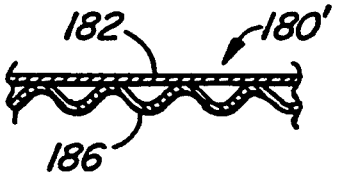
FIG. 5 is a view similar to FIG. 4 but showing another form of material from which the invention may be constructed.

Preferably, the container will be made from corrugated material such as a corrugated board 180 having a pair of liners 182 and 184 interconnected by the conventional corrugated liner 186 as shown in FIG. 4. Or alternatively, the container may be formed by a single face 180[1] formed by the liner 182 and the corrugated board 186 (i.e. the liner 184 is omitted) as shown in FIG. 5. When the single face 180[1] shown in FIG. 5 is used, corrugated layer 186 may face towards the inside or outside of the container. Obviously, if desired, other materials may be used but the materials shown in FIGS. 4 and 5 are preferred.

Having described the invention, modifications will be evident to those skilled in the art without departing from the scope of the invention as defined in the appended claims.

I claim:

1. A closable container comprising a bottom tray having a bottom wall, a set of bottom side walls, a fold line connecting each bottom side wall of said set of bottom side walls to an adjacent portion of said bottom wall, said set of bottom side walls including a first pair of opposed bottom side walls, means connecting one of said first pair of bottom walls to each of a pair of opposite sides of said bottom walk said first pair of bottom side walls forming a front bottom side wall and a rear bottom side wall of said tray, means for connecting adjacent sides of said bottom side walls of said set of bottom side walls to form said bottom tray with said bottom side walls extending upwardly from said bottom wall and flaring outward to provide an open top defined by free-end edges of said bottom side walls, said open top being larger in area than said bottom wall, a gabled top having a top wall and a set of top side walls, means connecting each top side wall of said set of top side walls with said top wall and means for interconnecting sides of adjacent pairs of said top side walls to form said gabled top with an open end remote from said top wall defined by free edges of said top side walls remote from said top wall, said open end being larger in area than said top wall, said set of top side walls including a first pair of opposed top side walls forming a front top side wall and rear top side wall of said gabled top and a second pair of opposed top side walls, said means interconnecting sides of adjacent pairs of said top side walls including flaps foldably connected to corners of each of said first pair of top side walls in a position to be secured to an adjacent corner of an adjacent side wall of said second pair of top side walls, a projection extending from each of said flaps, each said projection extending beyond its adjacent said top side wall of said second pair of top side walls to overlap an adjacent corner of said bottom tray when said container is in closed position, a foldable connection between said rear bottom side wall and said rear top side wall to foldably connect said gabled top with said bottom tray.

2. A closeable container as defined in claim 1 wherein said bottom front side wall has an undercut formed therein defining a supporting surface and said top front side wall has a projecting tongue planer therewith projecting therefrom away from said top wall, said undercut and said tongue being positioned to cooperate and lock said gabled top when said gable top is in a closed position over said bottom tray.

3. A closable container as defined in claim 2 further comprising an extending portion extending from an end of said bottom front side wall remote from said bottom wall, said extending portion having a free edge spaced above said bottom wall further than said support surface and wherein said supporting surface is substantially parallel to said foldable connection and said support surface and said foldable connection are substantially equally spaced above said bottom wall,

4. A closable container as defined in claim 3 wherein the distance between said foldable connection and a free edge of said front top wall remote from said foldable connection is substantially the same as the distance between said supporting surface and said foldable connection so that said free edge of said front top wall may be received within said extending portion of said bottom front wall when said gable top in in a closed position overlying said bottom tray.

5. A closable container as defined in claim 2 wherein said tongue traverses said bottom front wall at an angle of at least 15° when said gable top is in a closed position overlying said bottom tray.

6. A closable container as defined in claim 3 wherein said tongue traverses said bottom front wall at an angle of at least 15° when said gable top is in a closed position overlying said bottom tray.

7. A closable container as defined in claim 4 wherein said tongue traverses said bottom front wall at an angle of at least 15° when said gable top is in a closed position overlying said bottom tray.

8. A closable container as defined in claim 2 wherein said tongue traverses said bottom front wall at an angle of at least 30° when said gable top is in a closed position overlying said bottom tray.

9. A closable container as defined in claim 3 wherein said tongue traverses said bottom front wall at an angle of at least 30° when said gable top is in a closed position overlying said bottom tray.

10. A closable container as defined in claim 4 wherein said tongue traverses said bottom front wall at an angle of at least 30° when said gable top is in a closed position overlying said bottom tray.

* * * * *